US007028839B2

(12) United States Patent
Belloli et al.

(10) Patent No.: US 7,028,839 B2
(45) Date of Patent: Apr. 18, 2006

(54) BLANK AND BOX FOR VIALS AND PACKAGING PROCESS

(75) Inventors: Gianpaolo Belloli, Bologna (IT); Alessandro Resta, Milan (IT)

(73) Assignee: Societa per Azioni Curti - Costruzioni, Castel Bolognese (IT)

( * ) Notice: Subject to any disclaimer, the term of this patent is extended or adjusted under 35 U.S.C. 154(b) by 112 days.

(21) Appl. No.: 10/402,972

(22) Filed: Apr. 1, 2003

(65) Prior Publication Data

US 2003/0217944 A1 Nov. 27, 2003

Related U.S. Application Data

(63) Continuation-in-part of application No. 10/220,059, filed as application No. PCT/IT00/00249 on Jun. 16, 2000, now abandoned.

(30) Foreign Application Priority Data

Feb. 28, 2000 (IT) ..... Mi2000A0375

(51) Int. Cl.
*B65D 1/34* (2006.01)

(52) U.S. Cl. ..... 206/443; 206/446

(58) Field of Classification Search ..... 206/443, 206/562, 565, 485, 488, 446, 528; 229/120.17, 229/120.18, 120.24, 120.21
See application file for complete search history.

(56) References Cited

U.S. PATENT DOCUMENTS 2,014,461 A * 9/1935 Anton ..... 206/521.6
2,128,197 A * 8/1938 Weil ..... 206/777
3,251,528 A * 5/1966 Cilluffo ..... 229/116.1
3,115,247 A 7/1970 Hauser
3,921,895 A * 11/1975 Ziche ..... 206/486
4,498,420 A * 2/1985 Botterman et al. ..... 119/6.5
D351,344 S * 10/1994 Blott ..... D9/418
5,402,889 A 4/1995 Hermann et al.
5,871,145 A * 2/1999 Hermann et al. ..... 229/120.21

FOREIGN PATENT DOCUMENTS

| | | |
|---|---|---|
| DE | 20 03 135 | 7/1970 |
| EP | 0 522 225 | 1/1993 |
| EP | 0 784 015 | 7/1997 |
| WO | WO 99 12818 | 3/1999 |

* cited by examiner

*Primary Examiner*—Shian T. Luong
(74) *Attorney, Agent, or Firm*—Millen, White, Zelano & Branigan, P.C.

(57) ABSTRACT

The invention relates to a blank that comprises a lid portion of a box; a folding portion which can be erected to form an internal support (S) to house vials, ampoules, miniature bottles or similar articles endowed with a body, a neck and a head, that comprises at least one first section (7) endowed with a first plurality of holes (F7) and at least one second section (9) endowed with a second plurality of holes (F9), one of the two sections being provided with holes that have such dimensions as to retain said articles in correspondence of their necks and presenting around said retaining holes (F9) means for temporarily and reversibly increasing the dimensions of the said holes; at least one folding portion engaging with said internal support (S) for maintain it erect and square. The invention also relates to the boxes obtained from this blank and a procedure for packaging vials, ampoules, miniature bottles or similar articles in such boxes.

10 Claims, 10 Drawing Sheets

BLANK AND BOX FOR VIALS AND PACKAGING PROCESS

FIELD OF THE INVENTION

The present invention relates to a folding blank, the boxes obtained from this blank and a process for packaging vials, ampoules, miniature bottles or similar articles in such boxes.

More particularly the invention relates to a folding blank in one piece comprising a folding portion which forms a support to immobilize said vials, ampoules, miniature bottles or similar articles structurally constituted by a body, a neck and a head, and hereinafter referred to only as articles, inside the box.

STATE OF THE ART

Boxes are known with internal supports provided with two or more perforated and contra-positioned sections to house articles of lengthened shape such as vials, ampoules and similar articles generally made of glass.

U.S. Pat. No. 5,402,889 and U.S. Pat. No. 5,871,145 describe examples of such boxes prepared by starting from folding blanks in one piece. Such blanks are composed of various adjacent sections, which are suitably folded and glued, then filled with the desired articles and closed. According to such teachings, the internal support is initially folded and glued and left flattened; subsequently the remaining blank is folded, the walls and the box are glued—in flattened and semi-glued form—leaving the bottom and the part destined to be the lid open, then it is processed by suitable machinery to erect it, fill it with the articles and close it. U.S. Pat. No. 3,921,895 describes a box for vials equipped with a folding internal support to give a structure with three perforated sections, one of which rests on the base of the box to receive the body of the vials.

U.S. Pat. No. 3,115,247 describes another box for vials equipped with only two perforated sections, also in this case to hold the body of the vials. The vials are in contact with the bottom and the cover of the box, where a protection system is provided for the vials by means of embossing at the points of contact between the vials and the box. DE-A-2003135 refers to a blank as per U.S. Pat. No. 3,115,247, further comprising additional tabs that are folded to provide a shock absorbing means. An external sheath is required to complete the box.

These boxes present the drawback of requiring several assembly phases and can be filled only after the blank has been partially folded, glued and the semi-formed box opened out.

Beyond the assembly difficulties, the boxes known in the art present the drawback of not ensuring suitable immobilization of the articles that they contain. In fact, often said vials or miniature bottles touch the bottom or the walls of the boxes that contain them, or are not sufficiently immobilized in the support, with the consequence that a bump can damage them. U.S. Pat. No. 5,358,116 describes a box in which is housed an internal support, physically independent of the box, endowed with suitable coaxial holes to immobilize by the neck products such as, for instance, vials. In this way, two different containers (support and box) need to be provided, with consequent increase in packaging times and costs; furthermore, the support is used for a reduced number of vials, only in one line, and must be removed from the box when a vial has to be extracted.

DESCRIPTION OF THE INVENTION

The purpose of the present invention is to provide a box for vials, ampoules, miniature bottles or similar articles structuralally constituted by a body, a neck and a head, equipped with an internal support, obtained starting from a folding blank, able to retain said articles in a secure way to avoid their breakup in case the box is bumped or accidentally falls.

Another purpose of the invention is furthermore to provide a box suitable for being filled before being folded and glued, i.e. able to receive the vials in suitable positions in the internal support when only the support has been erected and the remaining body of the blank is still flat.

A further purpose of the invention is to provide a blank for the aforementioned purposes, which can be folded and glued, in particular suitable for forming the box in few operations.

Such purposes are achieved by the blank of the invention that comprises a portion able to be folded to give a suitable internal support to house and restrain the articles; beyond that, the blank of the invention possesses a lid portion of the box preferably having the characteristic that said portions are arranged on opposite sides of the blank.

The internal support is endowed with two facing sections provided with holes of such size to hold down the articles by their necks and in this way prevent accidental chipping or breakage.

Therefore, a first object of the invention is a blank as described in Claims from 1 to 5.

In particular, the invention relates to a blank that comprises:

a lid portion (1,2) for opening and closing the box;

adjacent blank sections (1–5) connected to said lid portion (2) and forming a base (4) wall and front (5) and back (3) walls of the formed box, said adjacent sections defining a major axis (B—B) of the blank;

lateral sections (12, 13; 12*a*, 13*a*) forming lateral walls of the formed box;

a foldable supporting portion (6–10) that comprises a plurality of sections each having a major axis (A—A) that is substantially perpendicular to the said major axis of the blank (B—B) and that can be erected to form an internal support (S) for housing vials, ampoules, miniature bottles or similar articles (18) having a body, a neck and a head, said supporting portion (S) comprising a first section (7) having a plurality of housing holes (F7) to house the body of said articles, an intermediate section (8), a second section (9) provided with a plurality of retaining holes (F9) having such dimensions as to retain said articles in correspondence of their necks, means (9*a*) for temporarily and reversibly increasing the dimensions of the said holes, located on said blank around said retaining holes (F9), and two sections (6, 9) to be glued on corresponding areas (15, 16) of said front wall (5) in order to secure said supporting portion to said blank;

at least one foldable portion of said blank (14; 13,23) engaging with said internal support (S) to maintain it erect and square during the vial insertion step, the remaining portions of said blank being in an open position.

In the present description the term "holes" means more or less regular circular openings or openings of different form, for instance, a flower or star. Immobilization of the neck is obtained by means of holes F9 disposed on one of the two sections of the internal support, said holes having dimensions selected specifically to retain the article at the narrowest point, i.e. the neck, and immobilize it. The F9 holes are smaller than the F7 holes, because they must retain the part of the article—the neck—with diameter smaller than the rest of the article, in particular the body.

The body of the article is engaged by holes F7 corresponding coaxially to the other perforated section of the blank, which is brought into a position parallel to the first perforated section when the internal support (S) is erected be filled with the articles. As already mentioned, holes F7 are wider than holes F9 since it is their function to surround the body of the article, while allowing a small amount of shifting or rotational play to prevent damage.

The particularly preferred aspects of the blank of the invention are reported in claims from 6 to 11.

BRIEF DESCRIPTION OF THE SKETCHES

Some preferred technical solutions of the invention will now be described in more detail with reference to the enclosed sketches which are by way of example and not limiting, in particular:

FIG. 1 is a plan view of a blank according to a preferred embodiment of the invention in completely extended form;

FIG. 1*a* is a plan view of a blank according to another preferred embodiment of the invention in completely extended form;

Figure 8:
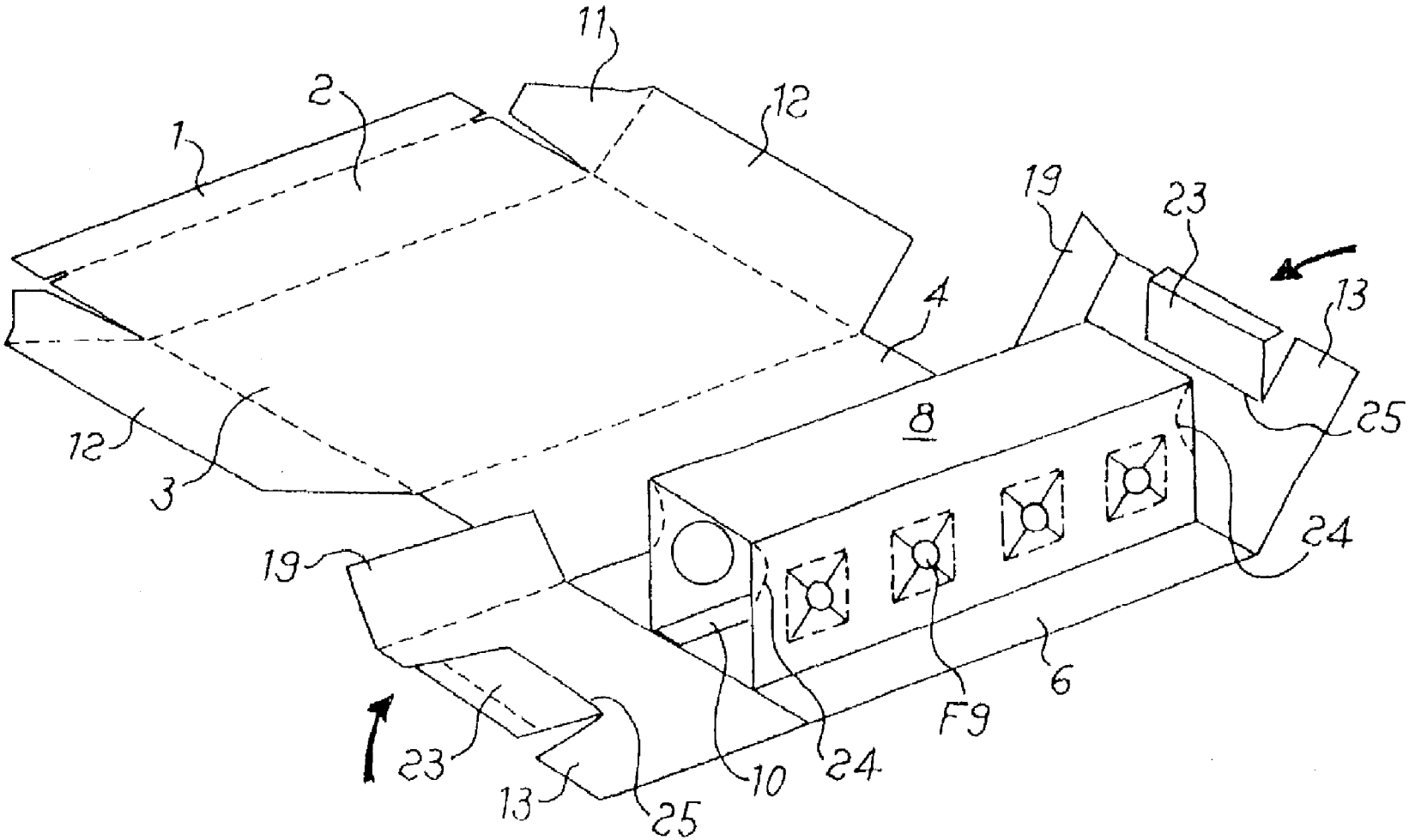
Figure 8A:
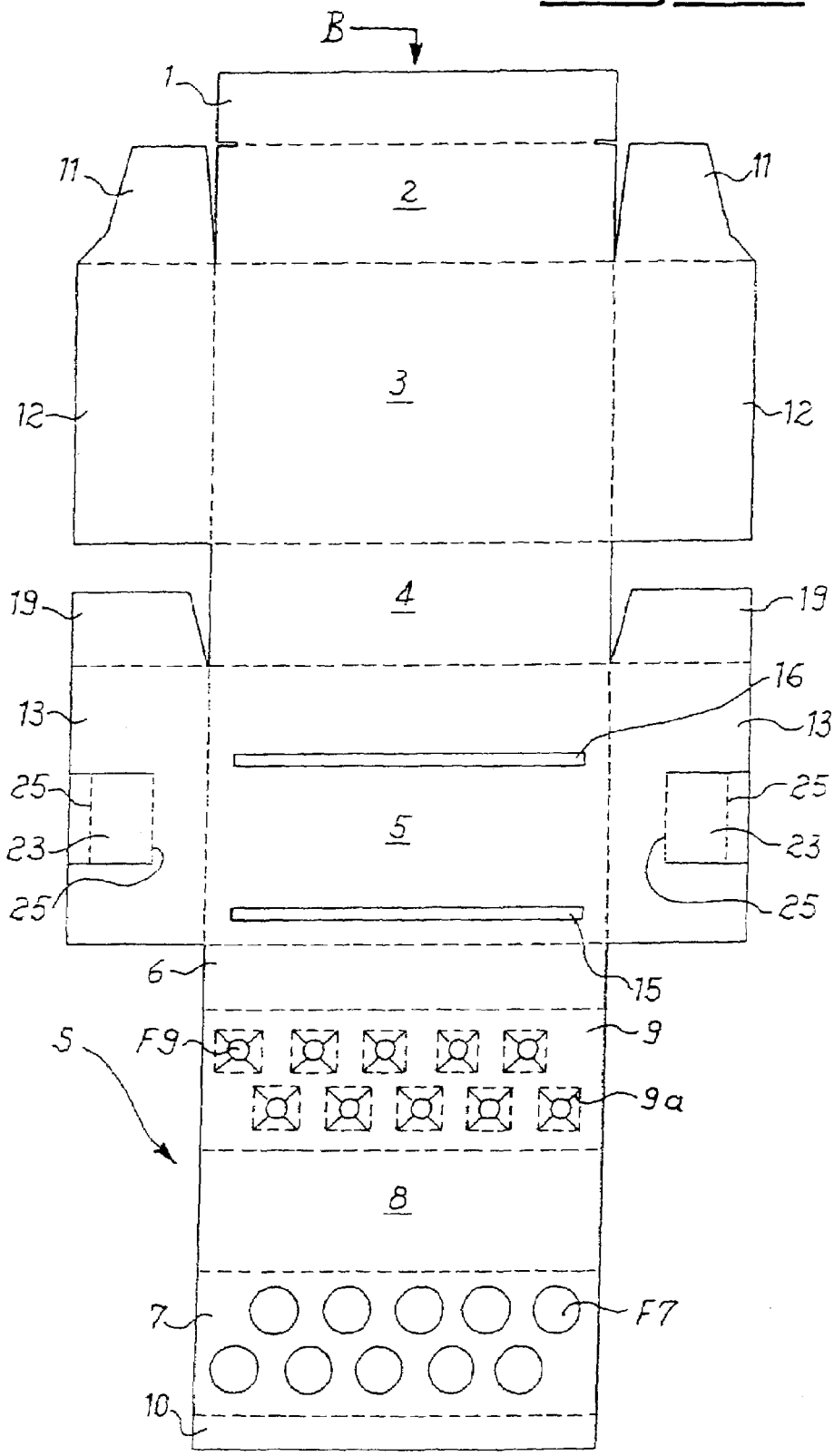
Figure 8B:
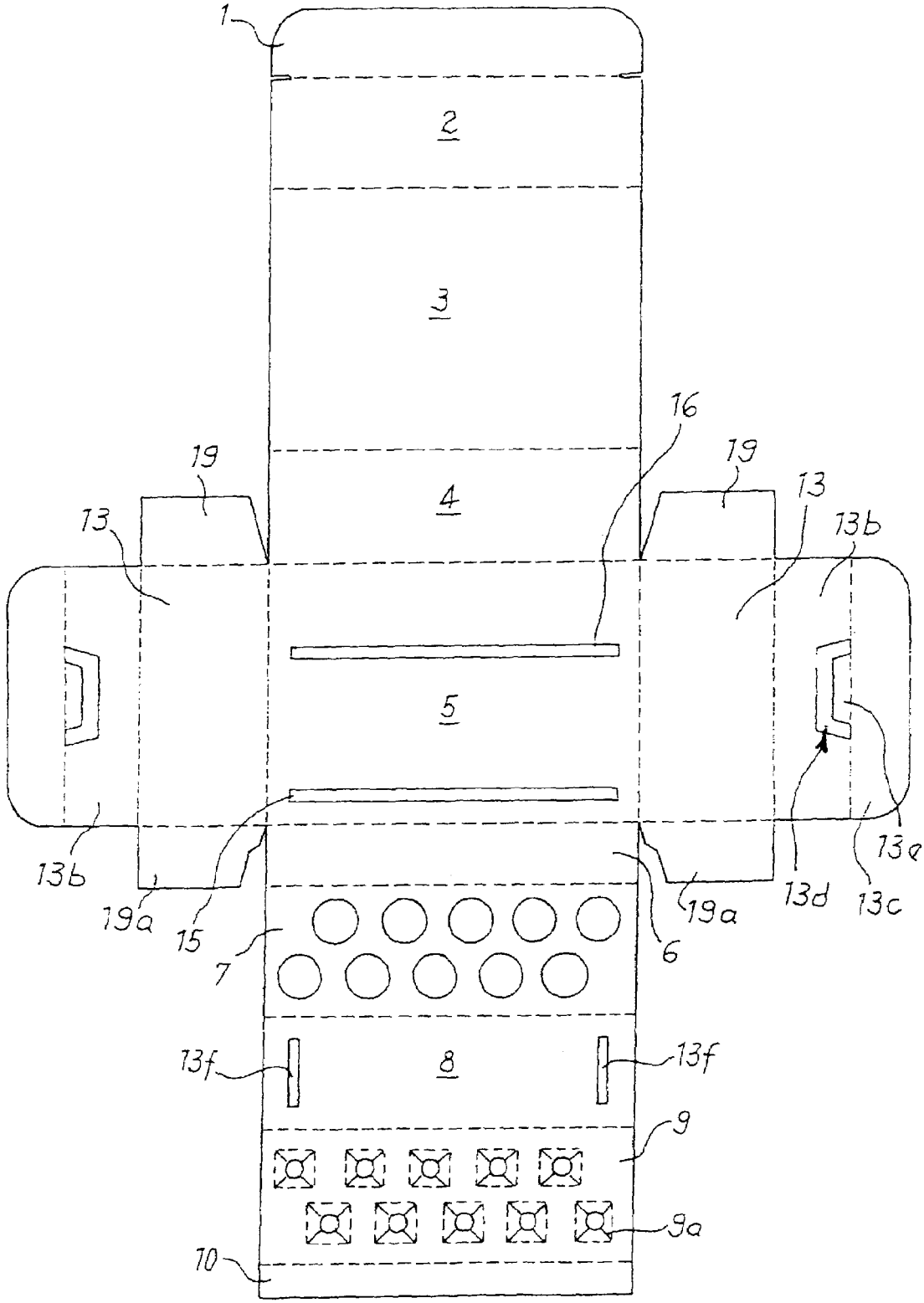

FIGS. 8 and 8*a* show a further embodiment of the blank;

FIG. 8*b* is a plan view of a further embodiment of the invention.

Figure 1:
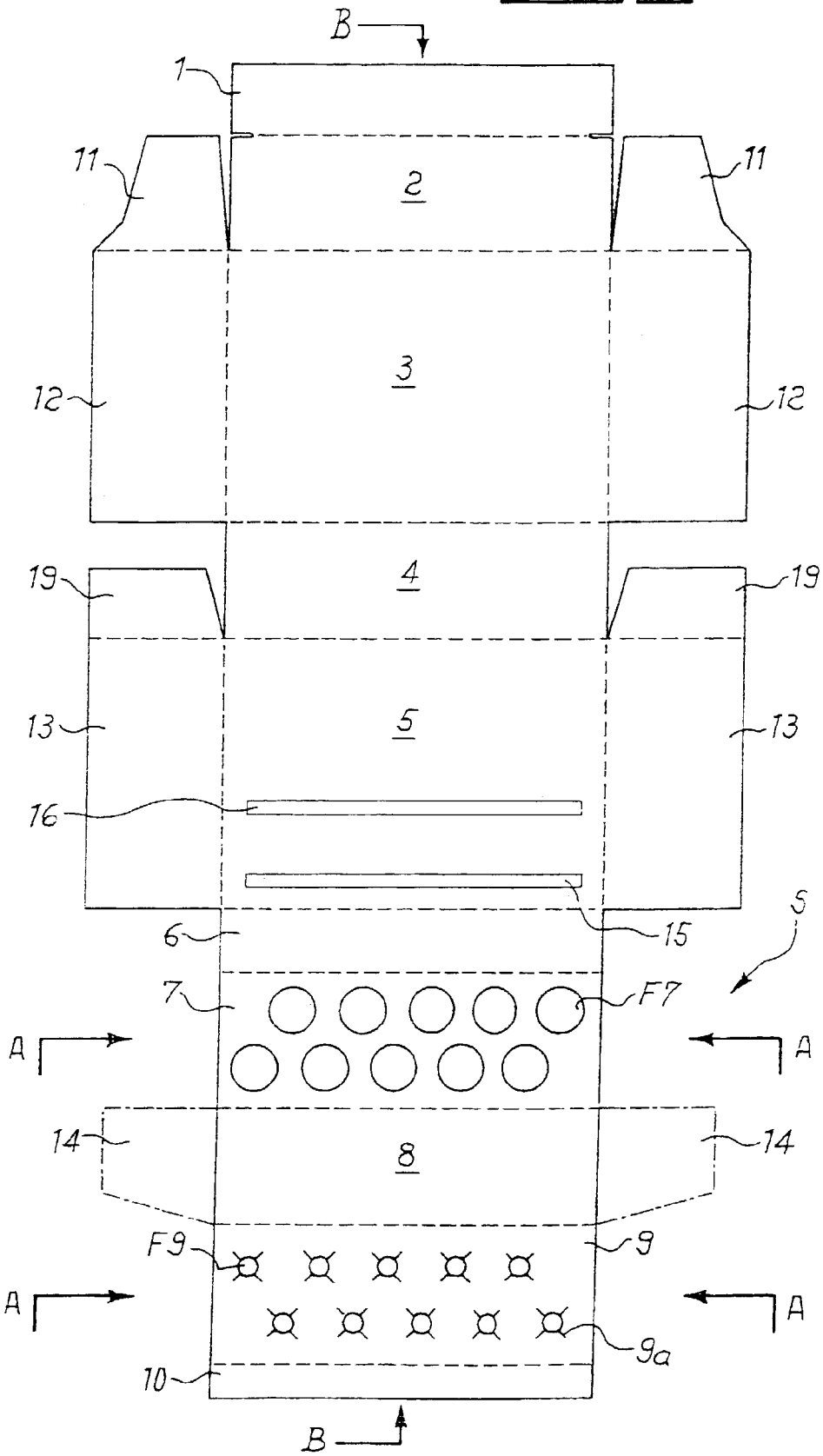

With reference to FIG. 1, a blank according to the invention comprises a primary structure having at least one flap 2 and a tab 1 forming a lid portion of the box, and a plurality of sections forming a back wall 3, a base 4, a front wall 5 and a portions 6 to 10 forming the internal support in which the vials are housed. The support portion of is preferably located on the opposite side, i.e. the opposite extremity of the blank with respect to the lid portion 1-2.

The support portion comprises two sections 6 and 10 to be glued on the front wall 5, two sections 7 and 9 equipped with lodging holes (F7) and retention and engagement holes (F9) for the vials, and an intermediary section 8 placed as a bridge between the two perforated sections. In the preferential embodiment shown, the sections 6–10 of the portions for lodging and supporting the vials are arranged each with its own major axis A—A substantially perpendicular to the major axis B—B of the primary structure of the blank.

As shown above, a characteristic of the invention is that the holes F9 of section 9 are smaller than the holes F7 of section 7; in particular, the holes F9 are of the same dimensions as the neck of the articles that they contain, and retain them in a protected position inside the box, keeping them from being damaged in the case of the box falling or being bumped.

In the present description, independently of their disposition in the structure of the blank, reference number 9 always refers to the perforated section endowed with the retaining holes F9 engaging the necks of the articles and number 7 always refers to the perforated section endowed with the holes F7 housing the bodies of said articles.

According to an advantageous embodiment of the invention, slits 9 that can be cross-shaped or differently shaped, for instance as shown in the Figures, are cut into the cardboard of the blank around said holes F9, to facilitate the introduction and the removal of the articles from the box. Advantageously, slits 9*a* have discontinuities that act as points of retention 21, shown in FIG. 7, that cooperate to immobilize the article, but easily tear when the vial is removed from the box. The points of retention 21 are positioned in such a way as to allow the introduction of the article into the support, allowing the passage of the head only of the article through the holes F9 without giving way. The points of retention 21 tear and give way to the passage of the body of the vial through said holes F9, facilitating their extraction from the box.

Figure 7:
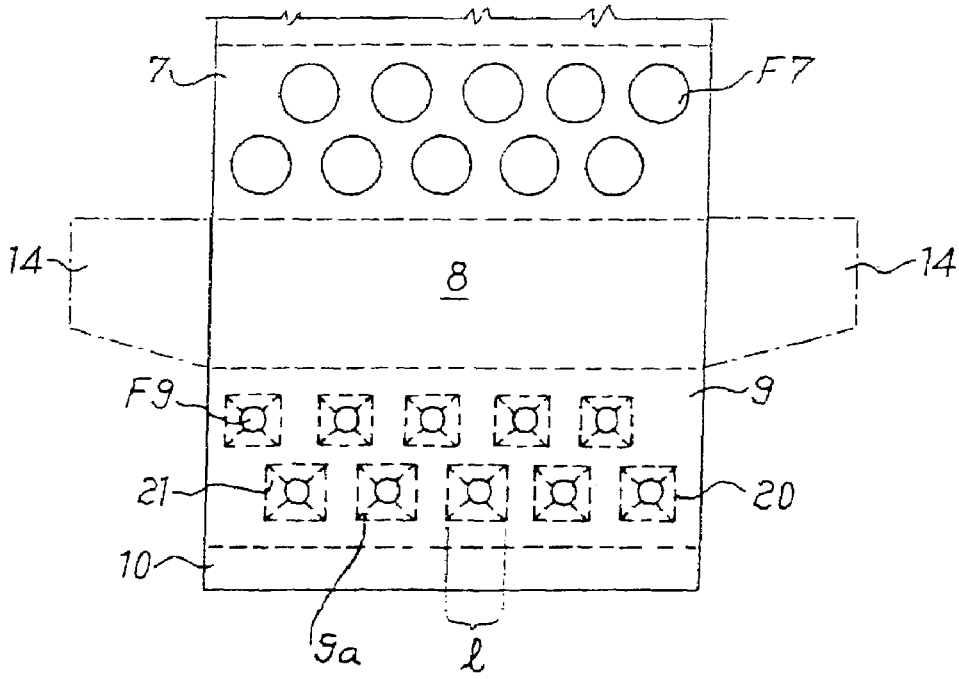

In particular, according to a preferred embodiment, holes F9 are surrounded by lines of folding (or weakening) 20 cut along the perimeter of polygons circumscribing retention holes F9; in particular FIG. 7 shows squares circumscribing the holes F9; but other forms—for instance pentagons, hexagons, etc.—could be provided.

According to a particularly advantageous embodiment, slits 9*a* extend up to the vertexes of said polygons; in this way the removal of the articles from the box is easier, they may be extracted by gripping them from the bottom of their body or from their head. In the latter case, during the extraction of the article, the body of the article passes through the passage delimited by the sides of the aforementioned polygons, opening the slit sections around the holes in the direction of the extraction; the blank bends in correspondence of the folding lines 20, without breaking as often happens when using the slits alone. In this way, the support remains substantially intact and the retention of the remaining vials is not compromised.

It is evident from the above that the polygons must have such dimensions as to allow the passage of the body of the article at the moment of its extraction from the box. In the case shown, the side L of the square is equal or greater than the diameter of the vial.

Figure 2:
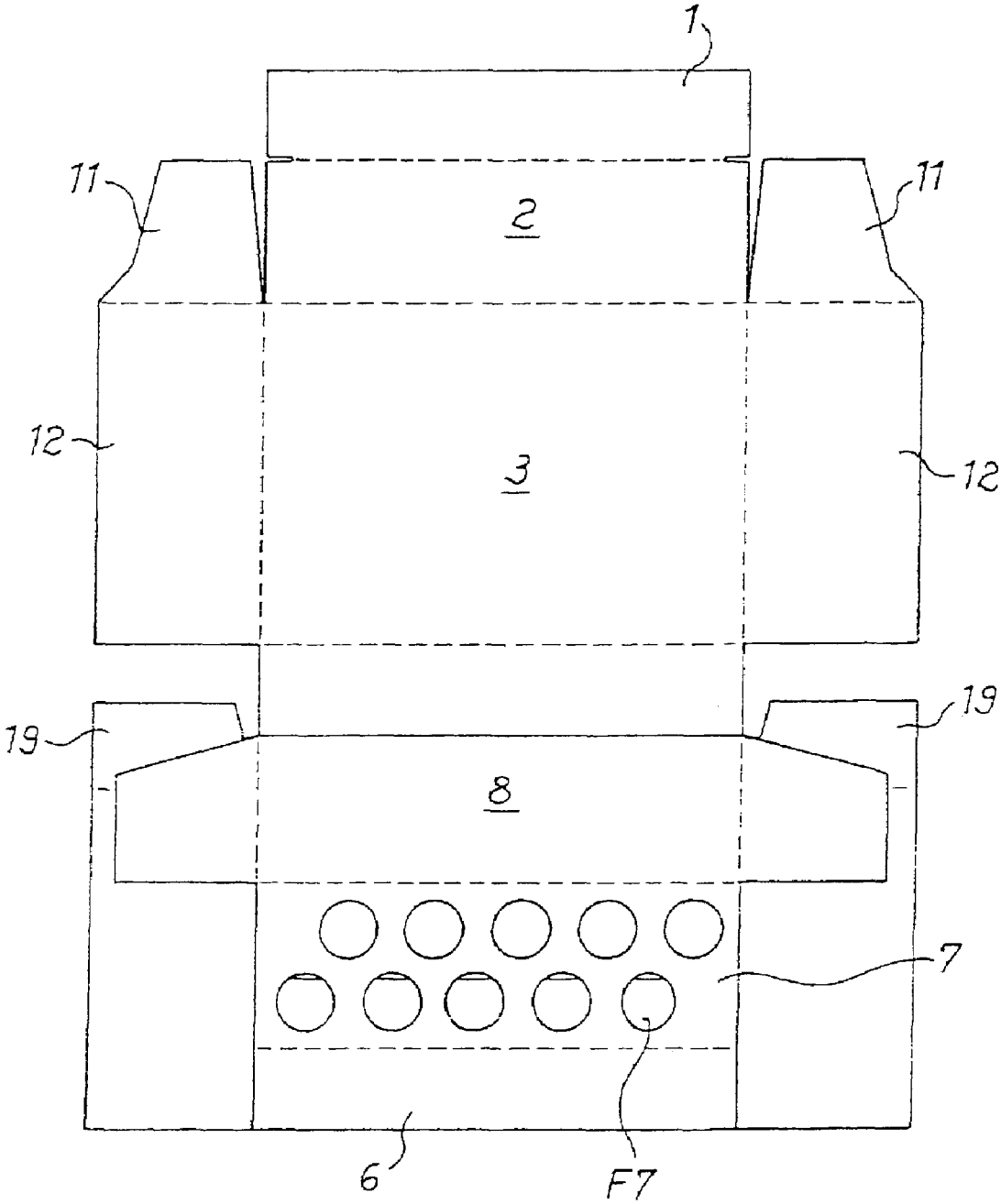
FIG. 2 is a plan view of the blank of FIG. 1 partially folded and glued to form the support for lodging vials.

This solution is particularly suited to the embodiment in which the vials are extracted from the box head first (FIGS. 2, 8 and 8*a*).

The perforated section 7 has the function of housing the bodies of the articles and is set at a distance from the section 9 defined by the dimensions of the intermediary section 8. The width of the holes F7 and F9 and the height of the intermediary section 8 can obviously vary and are selected on the basis of the dimensions of the article, even though the dimensions of the necks of vials or ampoules conventionally in use are very similar.

According to a preferred embodiment, the height of section 8 is comprised between 40% and 75% of the length of the body of the article, more preferably between 50% and 70%, advantageously between 55% and 65%, for instance 60%.

This particular dimension of the section 8 allows the blank of the invention to be used for more than one type of article, of different dimensions.

The disposition of holes F7 and F9 is advantageously chosen to ensure a reasonable guarantee against damage; the distance between the articles positioned inside and the walls and cover of the box is preferable at least some millimeters, preferably greater than 3 mm, advantageously 5–6 mm. Furthermore, the distance between two adjacent vials is preferably around 4–5 mm, so that even in the case of the box being bumped, the articles do not come into contact. In other words, given Lf the length of the vial and h the height of the structure that, as visible in FIG. 3, corresponds to the height of section 5 of the blank, then h=Lf+(3 mm×2). This is reflected in the height of section 6 that should be at least equal to the length of the projecting portion of vial plus the 5–6 mm indicated above; according to a preferential embodiment, the height of section 6 is equal to 80%–110% of the height of the section 8.

The holes F7 and F9 could be disposed along parallel lines, where necessary staggered or distributed in a different way, according to the ornamental and/or functional requirements, on the basis of the shape and size of the articles.

Figure 1A:
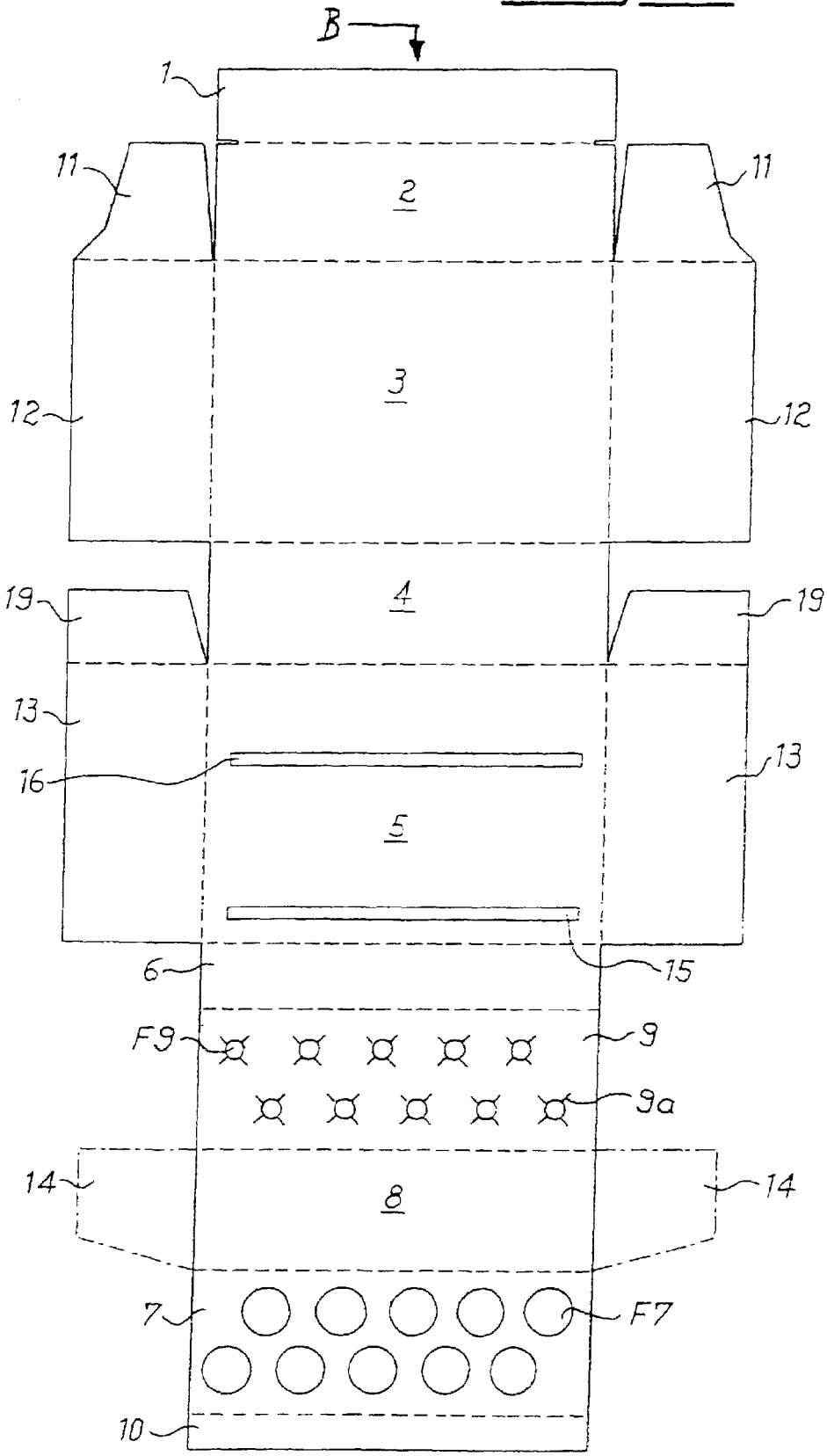

With reference to FIG. 1*a*, the blank shown is very similar to that of FIG. 1 in which however the disposition of the sections 7 and 9 is reversed; according to this technical solution, the vials will be arranged in the box obtained from folding the blank with their heads toward the flap 2, i.e. toward the opening of the box, contrary to the result obtained by folding the blank of FIG. 1, in which the vials are in the upside-down position.

The internal support S endowed with the aforementioned holes can be used for any type of blank to manufacture boxes containing vials, ampoules, miniature bottles or similar articles.

The blank of the invention also comprises a secondary structure; the sections of the blank constituting such structure could be of varying shape. The secondary structure, connected to the primary structure, forms the side walls of the box and comprises at least one folding portion engaging with the support S, constituted preferably by a flap interlocking with or glued to the internal support S.

FIGS. 1 and 1*a* show a secondary structure that comprises portions 12 and 13 of the blank that compose the sides walls and the flap 11 that is folded back at the moment of closing.

Section 14, indicated by a broken line, is a flap which is glued to the sides walls after the internal supporting section has been erected, as is clearly visible in FIG. 3 and described hereinbelow.

Figure 5:
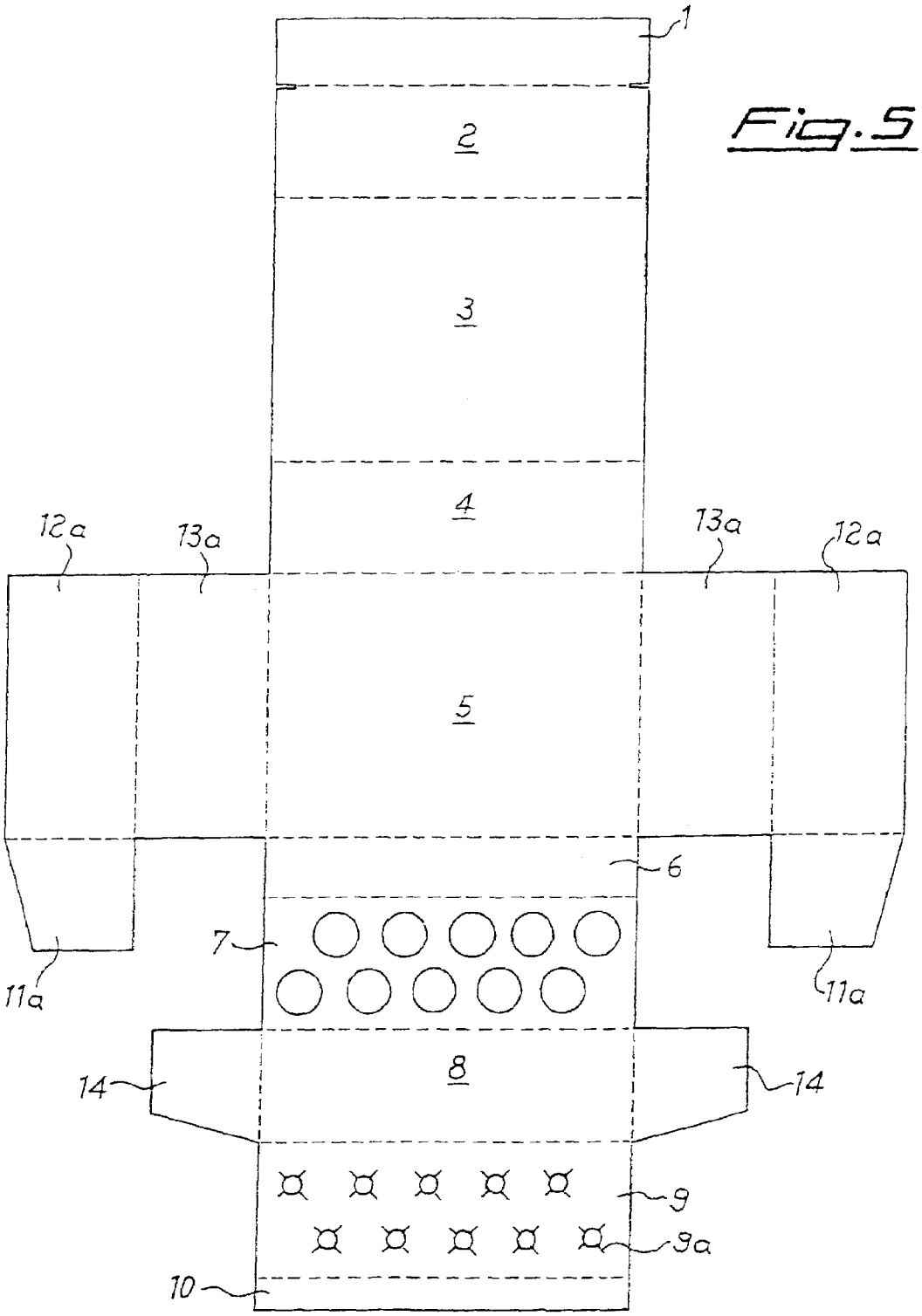
FIG. 5 is a plan view of another embodiment of blank according to the invention in flat extended condition.
Figure 6:
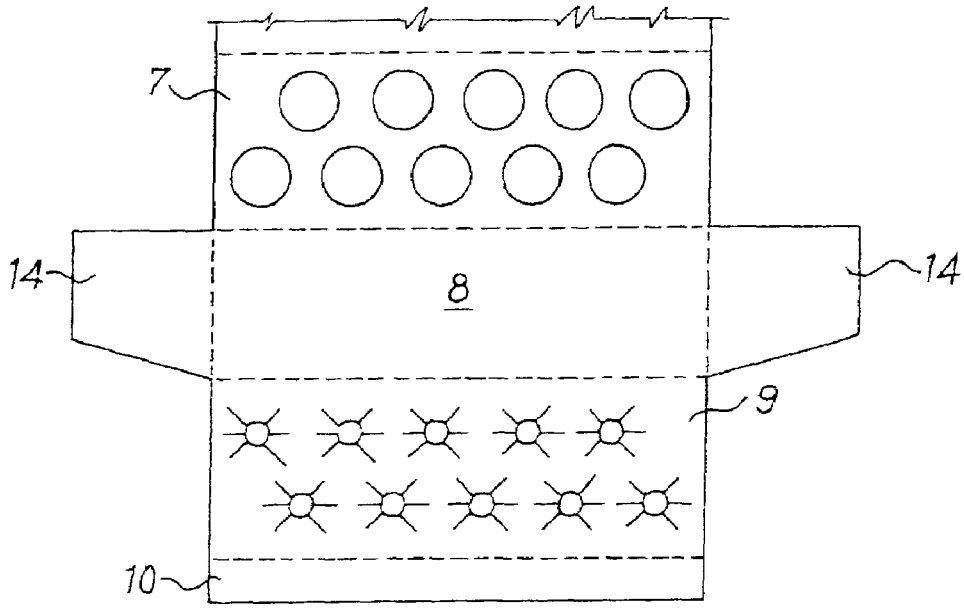
FIGS. 6 and 7 show the perforated sections in detail of the blank according to some embodiments.

With reference to FIG. 5, the blank of the invention comprises the primary structure of FIG. 1 but a different secondary structure having connected sections 13*a* and 12*a* and flap 11*a*. According to both the solutions, the blank is treated as follows: the blank is folded along the line between sections 5 and 6 and section 6 is glued internally to the front wall 5 in correspondence of the zone of application of glue indicated schematically by 15. In the same operation, sections 9 and 10 are also folded back along the fold line between sections 8 and 9 to bring them under sections 8 and 9, between these and section 5. Section 10 is glued in correspondence of the zone of application of the glue 16 on the wall 5, so that the support for lodging the vials is fixed to the body of the blank.

Figure 3:
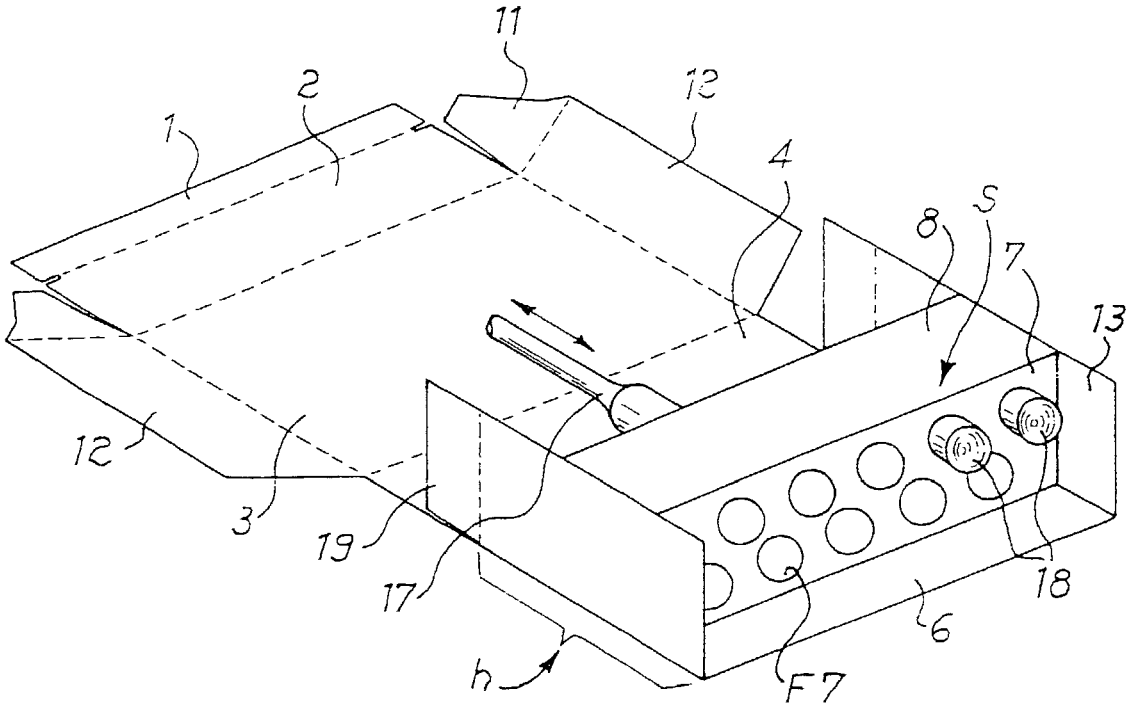
FIG. 3 is a prospective view of the blank of FIG. 2 with vial support erect and partially filled.

Afterwards, as shown in FIG. 3, the support portion is erected, i.e. lifted up, and flaps 14, where present, are glued to the sides walls 13 or 13*a*; the support remains accordingly in the open position. Other than by means of the fins 14, the support can also be maintained in open position by means of interlocking fins 23 (FIGS. 8 and 8*a*); if necessary, during packaging a temporary blocker or mechanical support present on the packing machine, and indicated schematically by reference number 17 in FIG. 3, will be used. In this way, the support for lodging articles 18 is held erected and open and can be filled according to conventional techniques while the rest of the blank is still in flat position, with the parts destined to form the walls and the base of the box still completely extended. If necessary, a leaflet or an illustrative brochure can be inserted at this point before further folding of the blank.

When this step is finished, the remaining blank is folded around the structure formed by the vial lodging support portion. In particular, the tabs 19 are folded and glued to section 4 , which will form the base of the box according to the invention. It should be noted that this box lacks an opening in correspondence of the base, this being formed by section 4 that is of one piece with the rest of the box body.

Figure 4:
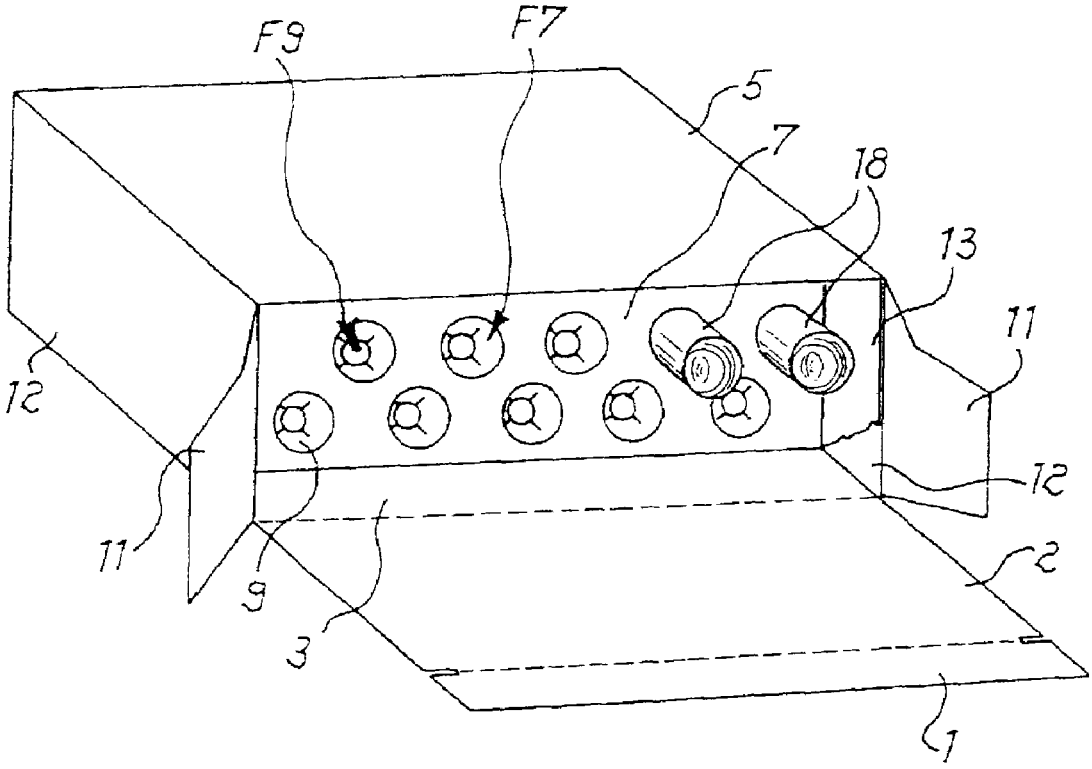
FIG. 4 is a prospective view of the finished box, open and partially filled.

At this point, section 3 is superimposed to section 8 and, in the solution provided in FIG. 1, sections 12 are glued to sections 13, while in the solution provided in FIG. 2, sections 12*a* are glued to the back wall 3. The box so formed and filled, shown in FIG. 4, can now be closed by folding the tabs 11 or 11*a* and the flap 2 in sequence, finally inserting tab 1 into the box body to close it.

FIGS. 8 and 8*a* show an alternative technical solution to the use of the flaps 14. According to this particular embodiment of the invention, the fins 23 are cut into the side flaps 13, folded along two folding lines 25 and inserted into the open sides of the erected internal support to the position indicated schematically by outline lines 24, to maintain the support portion of the blank erect and square during the phase of filling the box in the packaging procedure. Such predefined folding lines 25 are for instance fold-lines or semi-cut or perforated lines that allow to fold flaps 23 in two sections forming an angle.

Subsequently, the flaps 12 are glued onto flaps 13 similarly to the aforementioned previous figures.

FIG. 8*b* shows an embodiment for manual or semiautomatic packaging, in which the support portion is kept square by an additional flap 13*b* comprising a tab 13*c* with related fold-lines, a cutout 13*d* corresponding to the fold-line between flap and tab and a tongue 13*e* that sticks out into the cutout 13*d*. When the support section is erected and flap 13 is folded back, tongue 13 corresponds to and engages in a slot 13*f* cut into section 8. The procedure provides therefore for folding, gluing and erecting the support portion of the blank as in the other embodiments and keeping it square with the tongues 13*e* inserted into the slots 13*f*. After the vials have been inserted, the fins 19 are glued to section 4 and the box closed in the way described above.

Other fins or optional tabs could be present on the secondary structure when it is desired, for example, to strengthen any parts of the box by means of a double thickness of the blank.

The blank of the invention can be easily filled due to the interlocking and/or glued fins that maintain the internal support portion in erected position; furthermore, the open blank with the internal support erect could be filled equally from either of the two directions, since the remaining part of the box stays completely open and extended.

The blank of the invention is made of the conventional material for packaging such articles, for instance in cardboard and can be printed as desired before proceeding to its assembly.

The boxes of the invention are particularly suited for, but not exclusively destined to, the packaging of pharmaceutical products, such as injectable fluids, vitamin mixtures, fermentation products etc., or vegetable extracts such as, for instance, homeopathic products.

The procedure of the invention allows the boxes to be filled with the articles before said boxes are folded and partially glued, i.e. working with the blank extended.

The procedure of the invention therefore allows the steps necessary to the packaging to be reduced and thus reduces the costs of production accordingly.

What is claimed is:

1. A blank in one piece for foldable boxes, comprising a lid portion (1,2) for opening and closing the box;

adjacent blank sections (1–5) connected to said lid portion (2) and forming a base (4) wall and front (5) and back (3) walls of the formed box, said adjacent sections defining a major axis (B—B) of the blank;

lateral sections (12,13; 12*a*, 13*a*) forming lateral walls of the formed box;

a foldable supporting portion (6–10) that comprises a plurality of sections each having a major axis (A—A) that is substantially perpendicular to the said major axis of the blank (B—B) and that can be erected to form an internal support (S) for housing vials, ampoules, miniature bottles or similar articles (18) having a body, a neck and a head, said supporting portion (S) comprising a first section (7) having a plurality of housing holes (F7) to house the body of said articles, an intermediate section (8), a second section (9) provided with a plurality of retaining holes (F9) having such dimensions as to retain said articles in correspondence of their necks, means (9*a*) for temporarily and reversibly increasing the dimensions of the said holes, located on said blank around said retaining holes (F9), and said two sections (6,9) to be glued on corresponding areas (15,16) of said front wall (5) in order to secure said supporting portion to said blank;

at least one foldable portion of said blank (8; 13,23) engaging with said internal support (S) to maintain it erect and square during the vial insertion step, the remaining portions of said blank being in an open position.

2. A blank according to claim 1, characterized by said at least one folding and engaging portion being constituted by a flap (14;23,25) interlocking with and/or glued to said internal supporting portion (S).

3. A blank according to claim 2, characterized by said tabs (23) being provided with folding fins which interlock with the internal support (S).

4. A blank according to claim 1, characterized by the sections (7,9) being perforated and sufficiently spaced form the base (4) and from the lid tab (2) after the erection of the support (S) to maintain the extremities of said articles spaced from said base (4) to said lid tab (2).

5. A blank according to claim 1, characterized by said retaining holes being provided with a plurality of slits and being surrounded by weakening lines (20) defined by polygons circumscribing said holes.

6. A blank according to claim 3, characterized by said slits having points of retention (21).

7. A blank according to claim 1, characterized by said lid portion (2) of the box and said folding portion forming an internal support (S) being arranged on opposite sides of the blank.

8. A blank according to claim 1, characterized by said foldable portion (8) being provided with tabs (14) suitable for being glued to said side walls (13; 13*a*).

9. A box obtained from the blank of claim 1.

10. A box according to claim 9 comprising vials, ampoules or miniature bottles in glass, the neck of said vials, ampoules or miniature bottles being hold by said holes (F9) of the supporting portion (S) of the box.

* * * * *

UNITED STATES PATENT AND TRADEMARK OFFICE

CERTIFICATE OF CORRECTION

PATENT NO. : 7,028,839 B2
APPLICATION NO. : 10/402972
DATED : April 18, 2006
INVENTOR(S) : Belloli et al.

It is certified that error appears in the above-identified patent and that said Letters Patent is hereby corrected as shown below:

Column 8, line 10, change “form” to --from--.

Signed and Sealed this

Twenty-sixth Day of December, 2006

JON W. DUDAS
*Director of the United States Patent and Trademark Office*